United States Patent [19]

Ramadorai et al.

[11] Patent Number: 4,923,510

[45] Date of Patent: May 8, 1990

[54] TREATMENT OF REFRACTORY CARBONACEOUS SULFIDE ORES FOR GOLD RECOVERY

[76] Inventors: Gopalan Ramadorai, 3337 Enfield Ave., Elko, Nev. 89801; Brian Ball, 7355 S., 2200 East, Salt Lake City, Utah 84121; Ronald L. Atwood, 86 S., 350 East, Farmington, Utah 84025; Rong-Yu Wan, 213 University Village, Salt Lake City, Utah 84108; Sevket Acar, 3445 Highland Dr., Salt Lake City, Utah 84106

[21] Appl. No.: 406,839

[22] Filed: Sep. 13, 1989

Related U.S. Application Data

[63] Continuation of Ser. No. 264,632, Oct. 31, 1988, abandoned.

[51] Int. Cl.[5] ..... C22B 11/04

[52] U.S. Cl. ..... 423/29; 204/109; 423/25; 423/27; 423/29; 423/30; 423/31

[58] Field of Search ..... 75/101 R, 105, 118 R; 204/109; 423/27, 29, 30, 31, 25

[56] References Cited

U.S. PATENT DOCUMENTS

| | | | |
|---|---|---|---|
| 4,038,362 | 7/1977 | Guay | 423/29 |
| 4,259,107 | 3/1981 | Guay | 75/105 |
| 4,289,532 | 9/1981 | Matson et al. | 75/118 R |
| 4,552,589 | 11/1985 | Mason et al. | 423/27 |
| 4,731,114 | 3/1988 | Ramadorai et al. | 423/29 |
| 4,786,323 | 11/1988 | Gock et al. | 75/118 R |

*Primary Examiner*—Robert L. Stoll
*Attorney, Agent, or Firm*—Fred A. Keire

[57] ABSTRACT

Refractory carbonaceous sulfide ores are treated in a manner so as to improve gold recovery by a treatment in specific combination of steps whereby the ore is treated with chlorine after pretreatment and before cyanidation; the particular steps in the treatment of the ore have been found to be necessary as the conventional pretreatment will not improve the yields on any economic basis.

14 Claims, No Drawings

TREATMENT OF REFRACTORY CARBONACEOUS SULFIDE ORES FOR GOLD RECOVERY

This application is a continuation of application Ser. No. 07/264,632, filed Oct. 31, 1981, now abandoned.

This invention relates to an improved recovery of gold from ores which make it difficult to recover gold therefrom by prior methods of cyanidation.

BACKGROUND FOR THE PRESENT INVENTION

In the recovery of gold from its mineral sources with which gold is associated, a number of steps and combinations of steps have been proposed to improve the yields, that is, the recoverability of gold.

As the recoverability is a function of the refractoriness of the ore, a number of exploratory attempts have been made to obtain precious metals from the ore under the typical conditions under which, e.g., gold, has been extracted from these ores.

For recovery of gold, placer ores are, of course, the easiest ores to work. On the other end of the spectrum of ores, carbonaceous sulfide ores, that is, ores containing sulfides, e.g., pyrites, arsenopyrites, etc., and both inorganic and organic carbon characterize ores especially refractory for the recovery of precious metals using a typical cyanide process (even though these ores contain fairly high amounts of precious metals, such as gold and silver).

The standard method in the industry for extracting gold from gold bearing ores is cyanidation. This has been the industry's preferred method, such as for the recovery of gold from oxidized ores.

Inasmuch as cyanidation has proven, as shown below, to extract a negligible amount of gold from these refractory carbonaceous sulfide ores, many attempts have been made to improve recovery in the ore treatment, e.g., pretreatment, and the cyanidation step. For example, carbon in the form of 6×16 mesh activated coconut shells or extruded peat (Norit 3515) has been added to the leach slurry or solution when cyaniding the ore. Typically this method is denoted as "carbon-in-leach" cyanidation (CIL) or, with minor modifications, "carbon-in-pulp" (CIP) cyanidation.

Still further, this improvement, i.e., carbon-in-leach or carbon-in-pulp cyanidation, has been coupled with various pretreatment procedures to which the ore has been subjected. A great number of these pretreatment procedures have been described in the prior art and alleged as improving the results. A number of these pretreatment steps have been carried out under atmospheric conditions or under pressure in an autoclave.

Some of the shortcomings of these prior art pretreatments have been associated with undue consumption of the materials with which the ore has been treated, or producing unacceptable consequences in subsequent treatment steps. Other shortcomings have been an undue increase in treatment lixiviant consumption, or the leaching time or temperature constraints unacceptable for the efficacious recovery of the precious metals from the ore, and the like.

Nevertheless, some of the autoclave pretreatments in the so-called carbon-in-leach cyanidation have resulted, indeed, in a remarkable improvement when measured against the cyanidation, that is, straight cyanidation or carbon-in-leach cyanidation.

However, the potential or ultimate amount of gold in the ore which could be recovered still has been a goal against which all attempts have been measured. This goal has eluded many attempts, especialy on an industrial scale, and has been an incentive for a number of investigations. Such potentially complete recovery, although alleged to have approached substantially complete exhaustion of gold from the ore, has been mere speculation or economic nonsense. Hence, with respect to the autoclave pretreatment with carbon-in-leach or carbon-in-pulp cyanidation, various pretreatments still have fallen short of a complete exhaustion or substantially complete exhaustion of gold in the ore.

The degree of recoverability of gold is still influenced by and is a function of sulfides, the metal content of the ore associated with sulfides and, more importantly, the carbonaceous compound content of the ore.

Thus, with an increase of sulfide sulfur and organic carbon, all other conditions being equal, the refractoriness of the ore increases.

Refractoriness of ore, by definition, is based on the difficulty of each ore with which it, when treated by simple cyanidation, makes it difficult to extract gold from it or any precious metal recovered with gold.

A considerable effort has been devoted to the recovery of increasingly greater amounts of gold from these refractory ores. Such efforts have been illustrated, for example, in U.S. Pat. No. 4,259,107, and the prior art mentioned therein.

Similarly, U.S. Pat. No. 4,038,362 likewise discloses prior art methods and discusses these methods. This discussion is in the context of the prior attempts which have sought to increase the recovery of gold from organic carbonaceous sulfide ores. Other efforts have been illustrated in U.S. Pat. No. 3,574,600 and 3,639,925.

U.S. Pat. No. 4,289,532 discloses oxygen gas oxidation of carbonaceous gold containing ores in an alkaline medium followed by chlorination of the ore. Use of an alkaline medium has been asserted to be a critical requirement in the process. However, oxidation of sulfidic ores produces acid, and maintaining an alkaline medium requires initial introduction and augmentation with an alkali material so as to maintain this alkaline medium. Costwise and material handling-wise, additional material usage causes the process as disclosed in U.S. Pat. No. 4,289,532 to be less attractive compared to the disclosed process. Although the process disclosed in U.S. Pat. No. 4,289,532 may be favored for alkaline ores, i.e., ores containing dolomite and calcite, for sulfidic-carbonaceous ores the present process is vastly more favorable. (However, it is noted that the present process is less suited for ores which are classified as dolomitic or calcitic ores.)

BRIEF DESCRIPTION OF THE INVENTION

It has now been discovered that if a particular sequence in the treatment steps is being followed for recovering precious metals from refractory carbonaceous sulfide ores, the step sequence and the step procedures provide for vastly increased yields. This improvement shows an advance towards the goal of substantially complete extraction of gold from these highly refractory carbonaceous ores. Hence, gold extraction from an ore has now been made possible with the interposition, in proper sequence, of a chlorine gas (or oxides of chlorine and their salts, e.g., NaOCl, $Ca[OCl]_2$, HOCl) treatment preceded by the autoclave treatment of the ore and before carbon-in-leach or carbon-in-pulp cyanidation takes place.

DETAILED DESCRIPTION OF THE INVENTION

In gold-bearing ores which contain organic carbonaceous and inorganic carbonaceous materials and sulfide minerals in admixture with gold-bearing minerals, the recovery of the gold is highly dependent on the carbon and metal sulfide content. Even with the best prior art treatments, the practical recovery rates achieved have been in the order of about 70 to 78%, based on the total amount of gold present, as defined by the standard fire assay method of analysis. This level has been achieved if the sulfide sulfur and organic carbon contents have not been excessively high, and proper, economical pretreatment steps have been followed. On the other hand, the amount of gold (and associated precious metals) extracted decreases if metal sulfide or carbon content increases in the ore. Conversely, even for an increase in gold content, the amount of extraction does not necessarily increase if, e.g., the amount of pyrite sulfide increases.

Thus, in accordance with the present invention, a series of runs were conducted which established the unique interposition and treatment sequence that has provided the heretofore unachieved results. Needless to say, the economic advantages are sizable if gold extraction can be improved to such a degree and, at the same time, treatment costs may be held constant or decreased.

The ore which was used to achieve the above improvements came from a random sample of sulfidic-organic carbon-containing gold-bearing ores from the region around Carlin, Nevada. This ore, for a series of runs, showed an average of 0.20 ounces of gold per ton of ore, 2% of sulfide sulfur and 0.75% of organic carbon.

A typical analysis of this ore shows that it is about 70% quartz, 14% illite, 4% kaolinite, 4% alunite, 2% barite and 1% $FeO_x$ pyrites, etc. The assay value typically for this ore is bout 0.2 ounces of gold per ton of gold. This ore, if treated, shows gold recovery of 9% by simple carbon-in-leach cyanidation. Gold recovery by carbon-in-leach cyanidation following pressure oxidation is 55%. Gold recovery by carbon-in-leach cyanidation following chlorination, with 200 pounds of chlorine per ton of ore, is 87%.

In this ore, total sulfur is about 2.3%, and sulfide sulfur is about 2.0%. Total carbon is about 0.9%, of which organic carbon is about 0.75%. Iron is about 2.25%. (All percentages herein are by weight.) There are other small amounts of metals present, such as zinc, arsenic, strontium, rubidium, barium, vanadium and titanium, e.g., up to about 1.2% to 1.3%, total.

The following examples illustrate, on a comparative basis, the process and its improvements as disclosed herein.

EXAMPLE 1

| | |
|---|---|
| Composition of ore | identified immediately above. |
| Gold | 0.20 oz per ton of ore. |
| Sulfur | 2.0% sulfide sulfur. |
| Carbon | 0.75% organic carbon. |

| Run No. | Process | % Gold Extraction |
|---|---|---|
| 1 | Cyanidation | 0 |
| 2 | Carbon in leach cyanidation | 9 |
| 3 | Autoclave Pretreatment – CIL cyanidation | 55 |
| 4 | Autoclave Pretreatment – $Cl_2$ Treatment – CIL-cyanidation | 95 |
| 5 | $Cl_2$ treatment – cyanidation | 77 |
| 6 | $Cl_2$ treatment – CIL cyanidation | 87 |

(CIL - carbon-in-leach)

Conditions for Runs 1 to 6

1. The cyanidation solution and conditions were: ore ground to 63%-200 mesh: typically, 60% ± 10%-200 mesh; pH 10.5 was adjusted with lime, and pH is typically between 10.2 and 11; NaCN was maintained at 0.2 gm/liter; NaCN is typically 0.1 to about 0.5 gm/liter; Time of treatment was for about 24 hours; time is typically 10 to 72 hours.

2. The carbon-in-leach cyanidation solution and conditions were the same as for Run 1, with the addition of 10 gm/liter pulp activated carbon, i.e., granular carbon, e.g., Norit 3515.

3a. The autoclave conditions and pretreatment were as follows. Temperature was 220° C. Temperatures are typically from about 125° C. to 240° C.; a narrower range may be 160° C. to 230° C. $O_2$ overpressure was 150 to 200 psi. $H_2SO_4$ content was 20 lbs/ton of ore; $H_2SO_4$ content may range from about 5 to 30 lbs/ton; the preferred value is 20 lbs/ton. Ore content was 40% solids (on dry weight basis). Time was 4 hours; typically time may range from 1 to 6 hours; the preferred time is about 4 hours.

3b. Carbon-in-leach cyanidation was the same as in Run 1, plus 20 gm/liter carbon.

4a. The autoclave conditions and pretreatment were as follows. Temperature was 220° C. $H_2SO_4$ content was 20 lbs/ton. Ore content was 40% solids (on dry weight basis). Time was 4 hours.

4b. Chlorine treatment and amount used were as follows. Chlorine consumption was 92 lbs/ton of solids. Chlorine consumption is typically ore dependent and runs from about 60 to about 200 lbs/ton of solids. It is best to operate at a level which is based on maximum extractability for least chlorine consumption. Time was 4 hours; typically time ranges from 30 minutes to 24 hours, of about 3 hours to 5 hours is the preferred range. Temperature was 40° C.; typically temperature may be between 20° C. to 45° C.

4c. Carbon-in-leach cyanidation solution was the same as in Run 1, plus 20 gm/liter carbon.

5a. Chlorine treatment and amount of chlorine used were as follows. Chlorine consumption was 360 lbs/ton ore. Chlorine consumption was as above, but is ore dependent, and runs typically from about 100 lbs/ton to about 1,000 lbs/ton, and is invariably higher according to this procedure and proportional to the amont of sulfides present in the ore. Time of treatment was 4 hours. Temperature was 40° C.

b. Cyanidation conditions and solution were as follows. Ore was ground to 63%-200 mesh. Cyanidation time was 24 hours. Cyanidation pH was at 10.5 adjusted with lime and NaCN was maintained at 0.2 gm/liter.

6a. Chlorine treatment and amount of chlorine used were as follows. Chlorine consumption was 360 lbs/ton ore. Time of treatment was 4 hours. Temperature was 40° C.

b. Carbon-in-leach cyanidation solution was the same as for Run 1, plus 20 gm/liter carbon.

From the above five runs, it is evident that the above-described ore is very refractory using cyanidation as a reference level. Moreover, if carbon-in-leach cyanidation is used, the ore may also be considered to be very refractory. Typical autoclave pretreatment, that is, sulfuric acid pretreatment, increases the yields, but the pretreatment conditions are not sufficient for high gold extraction.

Mineral acids other than sulfuric acid may also be used, e.g., hydrochloric acid.

Although different autoclave pretreatments may also be used and have been in the past employed for the purpose, these autoclave pretreatments suffer a number of shortcomings.

Undue consumption of various pretreatment materials has been experienced, for example, as shown by Runs 5 and 6 where chlorine pretreatment consumes considerable uneconomic amounts of chlorine (for the amount of gold recovered). Use of either $Cl_2$ or any oxide of $Cl_2$, such as NaOCl or $Ca(OCl)_2$ or HOCl, still shows excessive amounts of reagent being consumed.

It is also evident from the chlorine pretreatment in Run 5 that good recoveries are achievable with straight chlorine pretreatment followe by carbon-in-leach cyanidation, but the consumption of reagents is excessive. Relative comparison of consumption of oxygen and chlorine points up the savings to a greater degree as oxygen is substantially entirely utilized, whereas chlorine is utilized to a maximum of about 50%. Relative cost comparison for these two reactant gases points up this difference to an even greater degree.

Still further, as the refractoriness of the ore is based on the carbonaceous nature and while no satisfactory explanation has been advanced up to this time which would explain and thereby provide definitive answers so as to improve the process further, the process as shown for Run 4 indicates, all conditions being equal, that the combination of treatments is certainly a vast improvement.

As it is evident also from the chlorine consumption in step 4 vis-a-vis chlorine consumption in step 5 and comparing the costs for pretreatment with oxygen, it is evident that the economics favor the process in Run 4.

EXAMPLE 2

Instead of treating a raw ore which has been ground to the necessary fineness, a concentrate and a tailing were treated. This concentrate was obtained by froth flotation with standard sulfide collectors and froth formers (as used in the industry). This concentrate contains 0.30 ounces of gold per ton of concentrate. Moreover, the concetrate had 4.6% by weight of sulfide sulfur, and 1.10% of organic carbon. Concentrates typically run from about 4.0% to about 30% of sulfide sulfur, and from about 0.5% to 10% of organic carbon. The above concentrate was obtained from the same ore source at Carlin, Nev. Other constituents for the concentrate are essentially as above.

The above-described 4 runs were then repeated, except Runs 4A and 4B excluded the flotation tailings from the autoclave (pressure leaching) step, and the following results were obtained.

Run 4B was from a similar material in which the concentrate assayed 0.46 ounces per ton gold, 7.3% sulfide sulfur, and 1.36% organic carbon.

| Run No. | % Gold Extraction |
|---|---|
| 1 | 0 |
| 2 | 44 |
| 3 | 59 |
| 4A | 79 |
| 4B | 87 |

As it is seen from the above two examples, if the amount of sulfide sulfur increases, as well as the amont of organic carbon, the relative amount of recovery is not predictably increased, namely—carbon-in-leach cyanidation shows improvements, whereas autoclave pretreatment and carbon-in-leach cyanidation shows very slight improvement.

Still further, for the present invention the additional amounts of organic carbon and sulfide sulfur decrease the recovery. It is evident therefrom that although the amount of gold has increased relatively speaking vis-a-vis the amount of gangue, the increased amount of sulfide sulfur and the organic carbon affect the percent of gold extraction.

This effect can be attributable to the increased consumption of reactants not only in the pretreatment stage, but also the increased consumption perhaps of chlorine to complete the oxidization of the ore so as to make it more amenable for the cyanidation and thus gold extraction.

While the above runs have been illustrated so as to afford a true and proper comparison, obviously there are a number of variations that can be made. The autoclave pretreatment may vary as to percent solids, acid content, temperature, oxygen overpressure, viscosity modifiers, acid pretreatments, etc.

A suitable oxygen overpressure as disclosed herein provides for faster and better reaction kinetics not achievable when, for example, air is bubbled through the suspended ore. This improved reaction is especially noted when some pyrites normally resistant to chlorination are oxygen pre-treated. Moreover, oxygen confinement in an autoclave provides for substantial recovery of oxygen gas and its reutilization.

The chlorine requirements vary with autoclave pretreatment. The better the sulfide minerals are oxidized, the lower the chlorine requirements will be. The various other pretreatment procedures may likewise be practised so as to boost additionally the percentage of gold recovered. In all of these variations, however, it must be first and foremost kept in mind that there is an envelope process, around an economic region, which can be practised as described herein. Outside this envelope of acceptable results, various substitutions may produce results approaching the presently achieved results, but these results are inferior.

In all cases in which the present process has been practised, it has been found that it gives the end results which favorably compare with any of the other end results advanced by the prior art, yet the process steps all fall into the realm of practical technology which can be readily carried out on a large scale.

While the exact reasons that cause the steps to produce the herein-observed results are not known and cannot be predicted, the results themselves bespeak the achievements that have been obtained based merely on the percent of gold extraction and gold recovery from these extremely refractory ores.

It is also evident from the above that various combinations and permutations may well be practised and advanced, but these are not to be understood as limiting the invention which has been defined in the claims to follow.

What is claimed is:

1. In a method for recovery of precious metals from carbonaceous sulfide ores or concentrates having present organic and inorganic carbon, said recovery employing carbon-in-leach cyanidation of the ores, the improvement comprising first pretreating said ores in an autoclave at a temperature between about 125° and 250° C. with a mineral acid and oxygen sufficient to oxidize said ore so as to minimize chlorine consumption by said ore, thereafter subjecting said ore to a chlorine gas or oxides of chlorine treatment and cyaniding said ore using a carbon-in-leach process.

2. The method as defined in claim 1, wherein said pretreating is in the presence of sulfuric acid at a temperature between about 125° and 250° C.

3. The process as defined in claim 1, wherein pyritic sulfide is present in the ore in the amount from about 0.2 to 30% by weight based on said ore or concentrate.

4. The method as defined in claim 1, wherein the ore also contains base metal sulfides.

5. The process as defined in claim 1, wherein a concentrate is being treated which contains from about 3.5% and higher of sulfide sulfur and 1.0% and higher of organic carbon.

6. The method as defined in claim 1, in which the chlorine gas is dispersed throughout the slurry at a rate and for a period of time such that the slurry is amenable to gold cyanide recovery.

7. The process as defined in claim 1, wherein the ore is wet ground with water to yield a slurry containing said ore of a mesh size of about 60% of −200 mesh, said ore is thereafter pulped to wherein the same contains from about 40 to about 50% by weight of solids; said slurry is heated and treated in an autoclave at a temperature within the range from about 125° C. and up, but less than 250° C., in the presence of oxygen and acid, the pretreated slurry cooled to about 30° C. to 90° C., and thereafter chlorinated.

8. The process as defined in claim 7, wherein the pretreatment is in the presence of sulfuric acid of 5 to 40 grams per liter concentration.

9. The process as defined in claim 1, wherein after the pretreatment the slurry was cooled to about 35° C. to 40° C., was maintained at this temperature for about four hours and during this time chlorine gas bubbled into and dispersed throughout the slurry for this period for a total chlorine consumption of about 60 pounds of chlorine per ton of solids; the slurry was then treated with lime to raise the pH to between 10.5 and 11.0, and cyanidation was for eight hours with a carbon-in-leach process.

10. The process as defined in claim 10, wherein the total chlorine consumption was less than about 120 lbs/ton, and said oxygen pretreatment was sufficient to maintain chlorine consumption by an ore or a concentrate at less than 120 lbs/ton.

11. The process as defined in claim 10, wherein total chlorine consumption was less than about 90 lbs/ton and said oxygen pretreatment was sufficient to maintain chlorine consumption by an ore or a concentrate at less than 90 lbs/ton.

12. The process as defined in claim 10, wherein total chlorine consumption was less than about 60 lbs/ton and said oxygen pretreatment was sufficient to maintain chlorine consumption by an ore or a concentrate at less than 60 lbs/ton.

13. The process as defined in claim 1, wherein gold is recovered from a concentrate or ore.

14. In a method for recovery of precious metals from carbonaceous sulfide ores or concentrates having present organic and inorganic carbon, said recovery employing carbon-in-pulp cyanidation of the ores, the improvement comprising first pretreating said ores in an autoclave at a temperature between about 125° and 250° C. with a mineral acid and oxygen sufficient to oxidize said ore so as to minimize chlorine consumption by said ore, thereafter subjecting said ore to a chlorine gs or oxides of chlorine treatment and cyaniding said ore using a carbon-in-pulp process.

* * * * *